US008464576B2

(12) United States Patent
Okuyama et al.

(10) Patent No.: US 8,464,576 B2
(45) Date of Patent: Jun. 18, 2013

(54) ENGINE OIL DEGRADATION-ESTIMATING DEVICE AND DEVICE FOR ESTIMATING ANTIOXIDANT PERFORMANCE OF ENGINE OIL

(75) Inventors: Yosuke Okuyama, Saitama-ken (JP); Masashi Maruyama, Saitama-ken (JP); Koichiro Aikawa, Saitama-ken (JP); Wataru Hoshikawa, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 606 days.

(21) Appl. No.: 12/664,314

(22) PCT Filed: Jun. 26, 2008

(86) PCT No.: PCT/JP2008/061629

§ 371 (c)(1),
(2), (4) Date: Dec. 11, 2009

(87) PCT Pub. No.: WO2009/004973

PCT Pub. Date: Jan. 8, 2009

(65) Prior Publication Data

US 2010/0180671 A1 Jul. 22, 2010

(30) Foreign Application Priority Data

Jun. 29, 2007 (JP) ..... 2007-172348
Jun. 29, 2007 (JP) ..... 2007-172349

(51) Int. Cl.
*G01N 11/00* (2006.01)

(52) U.S. Cl.
USPC ..... 73/53.01

(58) Field of Classification Search
USPC ..... 73/53.05, 53.01
See application file for complete search history.

(56) References Cited

U.S. PATENT DOCUMENTS

| | | | | |
|---|---|---|---|---|
| 4,742,476 | A | 5/1988 | Schwartz et al. | |
| 5,071,527 | A * | 12/1991 | Kauffman | 205/786 |
| 5,750,887 | A | 5/1998 | Schricker | |
| 6,253,601 | B1 | 7/2001 | Wang et al. | |
| 2004/0093931 | A1 | 5/2004 | Carlstrom et al. | |
| 2006/0005609 | A1 * | 1/2006 | Blomkvist et al. | 73/53.05 |

FOREIGN PATENT DOCUMENTS

| | | | |
|---|---|---|---|
| JP | 59-027260 | A | 2/1984 |
| JP | 61-065007 | A | 4/1986 |
| JP | 62-203915 | A | 9/1987 |
| JP | 03-024438 | A | 2/1991 |
| JP | 03-031746 | A | 2/1991 |
| JP | 04-118549 | A | 4/1992 |
| JP | 07-189641 | A | 7/1995 |

(Continued)

*Primary Examiner* — David A. Rogers
*Assistant Examiner* — Alex Devito
(74) *Attorney, Agent, or Firm* — Arent Fox LLP

(57) ABSTRACT

To provide an engine oil degradation-estimating device and a device for estimating antioxidant performance of engine oil which are capable of determining degradation and an antioxidant performance of engine oil inexpensively and accurately, thereby making it possible to properly determine degradation of the engine oil and the time for replacement of the engine oil.

The engine oil degradation-estimating device includes an ECU 2. The ECU 2 estimates an antioxidant performance OIT and a cleanliness preservation performance TBN of engine oil, and determines degradation of engine oil based on the estimated antioxidant performance OIT and cleanliness preservation performance TBN. The device for estimating antioxidant performance of engine oil also includes an ECU 2. The ECU 2 acquires concentration [FUEL] of fuel in engine oil, and estimates the antioxidant performance of the engine oil based on the acquired fuel concentration [FUEL].

2 Claims, 10 Drawing Sheets

FOREIGN PATENT DOCUMENTS

| | | | |
|---|---|---|---|
| JP | 08-226896 | A | 9/1996 |
| JP | 10-232224 | A | 9/1998 |
| JP | 2003-107000 | A | 4/2003 |
| JP | 2005-337096 | A | 12/2005 |
| JP | 2006-274931 | A | 10/2006 |

* cited by examiner

ENGINE OIL DEGRADATION-ESTIMATING DEVICE AND DEVICE FOR ESTIMATING ANTIOXIDANT PERFORMANCE OF ENGINE OIL

FIELD OF THE INVENTION

This invention relates to an engine oil degradation-estimating device for estimating degradation of engine oil used for lubricating an internal combustion engine, and a device for estimating an antioxidant performance of engine oil, which is used as an indicator for determining degradation of engine oil.

BACKGROUND ART

Engine oil has not only the function of lubricating the engine, but also various functions, including those of cleaning, rust prevention, and corrosion control. After engine oil is degraded, these functions cannot be maintained, and formation of sludge and the like can cause the trouble of the engine, such as damage thereto. Therefore, it is preferable to replace the degraded oil early depending on the degree of degradation thereof. On the other hand, from the viewpoint of environmental protection, it is demanded to reduce the amount of waste oil, and particularly in the case of engine oil, it is desired to prolong the intervals of replacement of engine oil due to the large volume of waste oil and the high frequency of the replacement. From the above-mentioned viewpoint of engine protection and environmental protection, it is a very important theme to accurately determine actual degradation of engine oil and appropriately set the time for replacement of engine oil.

Therefore, conventionally, there have been proposed various degradation determining devices concerning engine oil, and for example, one disclosed in Patent Literature 1 is known. This degradation determining device includes a first determination device that carries out determination according to properties of engine oil (hereinafter simply referred to as "oil"), and a second determination device that carries out determination according to information on engine operation. When either of the first and second determination devices determines that the oil is degraded, a display displays a notice that the oil is degraded to urge the driver to replace the oil.

The first determination device uses an optical sensor which emits light from a light emitting part thereof toward oil, and receives light reflected from the oil at a light receiving part thereof. When the amount of received light is smaller than a first predetermined reference value, it is judged that particles having relatively large sizes are generated within the oil, and hence it is determined that the oil is degraded. On the other hand, the second determination device calculates a cumulative value of the information on engine operation, such as mileage of an automotive vehicle, after oil replacement, and when the calculated cumulative value becomes equal to or larger than a predetermined second reference value, it is determined that the oil is degraded. Further, the above-mentioned first reference value for the first determination device is set to be more strict from the view point of using oil in a good condition, whereas the second reference value for the second determination device is set to be less strict from the viewpoint of using the oil to a limit within which the oil does not cause any engine trouble.

However, the conventional degradation determining device adopts the result of determination by the first determination device that uses the first reference value which is more strict, provided that the first determination device is normal.

Therefore, it is likely to be determined that the oil is degraded even when the degree of oil degradation is not so high, which causes the oil to be replaced too early, causing wasteful disposal of the used oil.

Further, when the first determination device is faulty, the result of determination by the second determination device which uses the second reference value is adopted as a backup. The method of determination employed by the second determination device, however, only estimates the degree of oil degradation according to the cumulative value e.g. of mileage after the replacement of oil. In contrast, the actual progress of degradation of oil largely differs depending not only on the mileage or cumulative value of the number of rotations of the engine, but also on the environment and conditions of operation of the engine. This makes it impossible for the second determination device to accurately determine the degree of oil degradation. Therefore, to more positively avoid the troubles of faulty lubrication and the like, it is necessary to set an extra safety factor to the second reference value, which makes the time of replacement of oil earlier.

Further, according to the conventional degradation determination device, the optical sensor is required to be provided for degradation determination by the first determination device, which accordingly increases the manufacturing costs.

Further, as another conventional degradation determining device concerning engine oil, one disclosed in Patent Literature 2 is known. This degradation determining device pays attention to an amount of antioxidant remaining in engine oil (hereinafter referred to as "oil") as an indicator for use in determining degradation of the oil, and the remaining amount of antioxidant is detected using an infrared spectrometer. In the degradation determination device, the infrared spectrometer is disposed in a bypass passage connected to a downstream side of an oil filter in an oil passage, and the infrared spectrometer determines an infrared absorbance of a wavelength indicative of a peak characterizing an infrared absorbance spectrum of the antioxidant. The remaining amount of antioxidant is calculated based on the absorbance. Thus, the degradation of oil is determined based on the thus calculated remaining amount of antioxidant.

However, in the conventional degradation determination device, it is required to use the infrared spectrometer, which is expensive, to determine the remaining amount of antioxidant, resulting in an increase in the manufacturing cost of the device.

The present invention has been made to solve the above problems, and a first object thereof is to provide an engine oil degradation-estimating device which is capable of determining degradation of engine oil inexpensively and accurately, thereby making it possible to properly determine the time for replacement of the engine oil.

Further, a second object of the invention is to provide a device for estimating an antioxidant performance of engine oil, which is capable of accurately determining the antioxidant performance of engine oil, and thereby properly determining degradation of engine oil and time for replacement thereof, without using an expensive sensor.

[Patent Literature 1] Japanese Laid-Open Patent Publication (Kokai) No. H07-189641.

[Patent Literature 2] Japanese Laid-Open Patent Publication (Kokai) No. H08-226896

DISCLOSURE OF THE INVENTION

To attain the first object, in a first aspect of the present invention, there is provided an engine oil degradation-estimating device for estimating degradation of engine oil for use in lubrication of an internal combustion engine 3, comprising antioxidant performance-estimating means (ECU 2, equation (1), step 5 in FIG. 8, FIG. 10) for estimating an antioxidant performance (oxidation induction time OIT in the present embodiment (the same applies hereafter throughout this section)) of engine oil, cleanliness preservation performance-estimating means (ECU 2, equation (18), step 4 in FIG. 8) for estimating a cleanliness preservation performance (total base number TBN) of the engine oil, and degradation estimation means (ECU 2, step 6 in FIG. 8, FIG. 14) for estimating degradation of the engine oil based on the estimated antioxidant performance and cleanliness preservation performance.

The present invention is based on the following technical viewpoints: An antioxidant performance and a cleanliness preservation performance are key performances which have large influences on the degree of degradation of engine oil. The antioxidant performance is exhibited by antioxidant added to engine oil, and is exhibited by a side effect of peroxide decomposer added to the same originally for friction adjustment. When the antioxidant performance sufficiently exists in the engine oil, even if an oxidation product is mixed in the oil, no insoluble component is generated or no sludge is produced, whereas when the consumption of the antioxidant performance proceeds, insoluble components are generated in a low-temperature portion of the engine oil, and agglomerate to form sludge (hereinafter referred to as "low-temperature sludge"). When the low-temperature sludge is formed, various functions of engine oil are rapidly lost, which leads to a trouble, such as faulty lubrication or clogging of an oil passage. As described above, the antioxidant performance is one of oil degradation parameters excellently representing the degree of degradation of engine oil, and the remaining life of engine oil can be determined based on the remaining amount of the antioxidant performance.

On the other hand, the cleanliness preservation performance is exhibited by a cleaning agent added to the engine oil. When the cleanliness preservation performance sufficiently exists in the engine oil, as engine oil in a high-temperature state evaporates, insoluble components also evaporate together therewith, so that no sludge is formed. On the other hand, as the consumption of the cleanliness preservation performance proceeds, even if engine oil evaporates, insoluble components remain without evaporating and agglomerate to form sludge (hereinafter referred to as "high-temperature sludge"). The situation in which the high-temperature sludge is formed is basically the same as in the case of formation of the low-temperature sludge described above, and various functions of engine oil are rapidly lost, which leads to troubles, such as faulty lubrication and sticking of a piston ring. As described above, the cleanliness preservation performance is also one of oil degradation parameters excellently representing the degree of degradation of engine oil, similarly to the antioxidant performance, and the remaining life of engine oil can be determined based on the remaining amount of the cleanliness preservation performance.

Further, the antioxidant performance and the cleanliness preservation performance are different in the factors and mechanism of the consumption, as described above, and hence different in the situation of consumption (initial and final stages, rate, etc. of the consumption) and the degree of progress. Therefore, depending on the operating environment of the engine, the antioxidant performance is first consumed to have influence on the life of the engine oil, or the opposite may be the case. Therefore, if the degradation determination is performed based on one of the antioxidant performance and the cleanliness preservation performance, it is impossible to obtain a high determination accuracy, and in order to positively avoid the trouble caused by the degradation of engine oil, it is required to set the safety factor for the determination to be high, which results in wasteful replacement of engine oil.

Based on the above-described technical viewpoints, according to the present invention, the antioxidant performance and the cleanliness preservation performance of engine oil are estimated, and based on the estimated antioxidant performance and cleanliness preservation performance, the degradation of engine oil is estimated. Thus, the degradation estimation is carried out using two different types of oil degradation parameters, i.e. the antioxidant performance and the cleanliness preservation performance, which makes it possible to accurately estimate degradation of engine oil while setting the safety factor for the estimation to be smaller than when a single oil degradation parameter is employed, and therefore, it is possible to properly determine the time for replacement of engine oil. Further, the antioxidant performance and the cleanliness preservation performance are determined by estimation, which makes it unnecessary to use a determination-dedicated sensor as employed in the conventional degradation determining device, and hence the present engine oil degradation-estimating device can be constructed more inexpensively.

Preferably, the engine oil degradation-estimating device further comprises first remaining life parameter-calculating means (ECU, step 51 in FIG. 14, FIG. 15) for calculating a first remaining life parameter (remaining life indicator ROIT) representative of a remaining life of the engine oil, based on the antioxidant performance, and second remaining life parameter-calculating means (ECU2, step 52 in FIG. 14, FIG. 16) for calculating a second remaining life parameter (remaining life indicator RTBN) representative of a remaining life of the engine oil, based on the cleanliness preservation performance, wherein the degradation estimation means determines degradation of the engine oil based on a smaller one (remaining life indicator ROLF) of the calculated first and second remaining life parameters (steps 53 to 56 in FIG. 14).

With this configuration of the preferred embodiment, the first remaining life parameter and the second remaining life parameter representative of remaining lives of the engine oil are calculated based on the antioxidant performance and the cleanliness preservation performance, respectively, and the degradation of engine oil is determined based on a smaller one of the calculated parameters. That is, out of the antioxidant performance and the cleanliness preservation performance, one indicating a shorter actual remaining life is used to carry out the degradation determination, which makes it possible to accurately determine the time for replacement of engine oil. Further, according to the determination method described above, the safety factor for each of the antioxidant performance and the cleanliness preservation performance can be configured to be smaller, whereby the accuracy of degradation determination can be further enhanced.

More preferably, the antioxidant performance-estimating means comprises first antioxidant performance-estimating means (equation (5), steps 35 and 40 in FIG. 10) for estimating an antioxidant performance of an antioxidant contained in the engine oil, as a first antioxidant performance (OIT corresponding to antioxidant; $[OIT]_{AH}$), and second antioxidant performance-estimating means (equation (6), steps 39 and 40 in FIG. 10) for estimating an antioxidant performance of a peroxide decomposer contained in the engine oil as a second antioxidant performance (OIT corresponding to peroxide decomposer; $[OIT]_{ZN}$), and calculates the antioxidant performance (total OIT $[OIT]_{TOTAL}$) based on the estimated first and second antioxidant performances (equation (1), step 40 in FIG. 10).

As described above, the antioxidant performance is exhibited by antioxidant and peroxide decomposer added to engine oil. Further, the antioxidant and the peroxide decomposer are different in the manner of consumption thereof, and it has been confirmed that the former is consumed in a manner generally linear with respect to time, and the latter in a manner generally exponential with respect to the same. According to the present invention, the antioxidant performance of the antioxidant and that of the peroxide composer are separately grasped, and are estimated as the first antioxidant performance and the second antioxidant performance, which makes it possible to accurately perform these estimations according to the different manners of the consumption. Further, the antioxidant performance is calculated based on the estimated first and second antioxidant performances, it is possible to properly estimate the antioxidant performance of the engine oil in its entirety.

Further, to attain the first object, in a second aspect of the present invention, there is provided an engine oil degradation-estimating device for estimating degradation of engine oil for use in lubrication of an internal combustion engine, comprising first degradation parameter-calculating means (ECU 2, equation (1), step 5 in FIG. 8, FIG. 10) for calculating a first degradation parameter (oxidation induction time OIT) representative of a degree of formation of a low temperature-time degradation product in engine oil, second degradation parameter-calculating means (ECU 2, equation (18), step 4 in FIG. 8) for calculating a second degradation parameter (total base number TBN) representative of a degree of formation of a high temperature-time degradation product in the engine oil, and degradation estimation means (ECU 2, step 6 in FIG. 8, FIG. 14) for estimating degradation of the engine oil based on the calculated first and second degradation parameters.

As described hereinabove, the degradation of engine oil appears as formation of low-temperature sludge in a low-temperature portion of the engine oil caused by consumption of the antioxidant performance, or as formation of high-temperature sludge in a high-temperature potion of the engine oil caused by consumption of the cleanliness preservation performance. Therefore, the degree of formation of the low temperature-time degradation product including low-temperature sludge and the degree of formation of the high temperature-time degradation product including high-temperature sludge are oil degradation parameters which excellently represent the degrees of degradation of engine oil, respectively.

According to this invention, the first degradation parameter representative of the degree of formation of the low temperature-time degradation product and the second degradation parameter representative of the degree of formation of the high temperature-time degradation product are calculated, and the degradation of the engine oil is determined based on the calculated first and second degradation parameters. Thus, the degradation determination is performed using the two different oil degradation parameters, i.e. the first and second degradation parameters in combination. Therefore, similarly to the invention as claimed in claim 1, it is possible to accurately determine the degradation of engine oil while setting the safety factor to be small, and properly determine the time for replacement of engine oil. Further, the first and second degradation parameters are determined by estimation, and hence a determination-dedicated sensor can be dispensed with, which makes it possible to construct the engine oil degradation-estimating device inexpensively.

Further, to attain the second object, in a third aspect of the present invention, there is provided a device for estimating an antioxidant performance of engine oil, which is used as an indicator for determining degradation of engine oil, comprising fuel concentration-acquiring means (ECU 2, step 3 in FIG. 8, FIG. 9) for acquiring a concentration of fuel in the engine oil (fuel concentration [FUEL]), and antioxidant performance-estimating means (ECU 2, equation (1), step 5 in FIG. 8, FIG. 10) for estimating an antioxidant performance of engine oil (oxidation induction time OIT), based on the acquired concentration of fuel.

The present invention is based on the following technical viewpoints: As described above, as an important performance that has large influence on the degree of degradation of engine oil, there is the antioxidant performance. The antioxidant performance is an oil degradation parameter excellently indicative of the degree of degradation of engine oil, and based on the remaining amount of the antioxidant performance, the remaining life of engine oil can be determined. By the study of the inventor, it has been confirmed that the concentration (dilution rate) of fuel contained in the engine oil has large influence on the consumption and degradation of the antioxidant performance. This is because the unburned fuel is a highly reactive substance, and when brought into contact with the engine oil, the unburned fuel easily reacts with the oil, causing degradation of the antioxidant performance.

Based on the above-described technical points of view, according to the present invention, the concentration of fuel in engine oil is acquired, and based on the acquired concentration of fuel in engine oil, the antioxidant performance of the engine oil is estimated. Therefore, it is possible to accurately estimate the antioxidant performance while causing the influence of fuel contained in the engine oil to be reflected thereon, whereby it is possible to properly determine the degradation of engine oil and the time for replacement thereof. Further, when the acquisition of the fuel concentration is performed e.g. by estimation, it is unnecessary to provide a dedicated sensor for the determination, and when the same is performed by detection, the sensor for detecting the concentration is much less expensive than the conventional infrared spectrometer. Therefore, in both of the cases, it is possible to reduce the manufacturing costs of the estimation device.

Preferably, the device for estimating an antioxidant performance of engine oil further comprises oil temperature-acquiring means (ECU 2, step 1 in FIG. 8) for acquiring a temperature of engine oil (oil temperature TOIL), and NOx concentration-acquiring means (ECU 2, step 2 in FIG. 8) for acquiring a NOx concentration [NOx] within a crankcase 3*e* of the engine 3, wherein the antioxidant performance-estimating means estimates the antioxidant performance further based on the acquired oil temperature and NOx concentration.

As other parameters having influence on the consumption and degradation of the antioxidant performance, there may be mentioned the temperature of engine oil and the NOx concentration within the crankcase. The former can be mentioned because when oxygen in the air is brought into contact with engine oil, it directly reacts with the oil to degrade the antioxidant performance, and the degree of the reaction varies with the heat (temperature). As to the latter, NOx is also a very highly reactive substance, and when brought into contact with engine oil, it easily reacts with the oil, causing degradation of the antioxidant performance.

According to the present invention, the temperature of engine oil and the NOx concentration within the crankcase are acquired, and the antioxidant performance is estimated based on the acquired oil temperature and NOx concentration, in addition to the fuel concentration. Therefore, it is possible to accurately estimate the antioxidant performance while causing the influence of the temperature and NOx to be reflected thereon, whereby it is possible to more properly determine the degradation of engine oil and the time for replacement thereof.

Preferably, the antioxidant performance-estimating means comprises first antioxidant performance-estimating means (equation (5), steps 35 and 40 in FIG. 10) for estimating an antioxidant performance of an antioxidant contained in the engine oil as a first antioxidant performance (OIT corresponding to antioxidant; $[OIT]_{AH}$), and second antioxidant performance-estimating means (equation (6), steps 39 and 40 in FIG. 10) for estimating an antioxidant performance of a peroxide decomposer contained in the engine oil as a second antioxidant performance (OIT corresponding to peroxide decomposer; $[OIT]_{ZN}$), and calculates the antioxidant performance based on the estimated first antioxidant performance and second antioxidant performance (equation (1), step 40 in FIG. 10).

As mentioned above, the antioxidant performance is mainly exhibited by antioxidant. In addition thereto, the antioxidant performance is exhibited by the side effect of a peroxide decomposer added to engine oil originally for adjustment of friction. Further, the antioxidant and the peroxide decomposer are different in the manner of consumption thereof, and it has been confirmed that the former is consumed in a manner generally linear with respect to time, and the latter in a manner generally exponential with respect to the same. According to the present invention, the antioxidant performance of the antioxidant and that of the peroxide composer are separately grasped, and are estimated as the first antioxidant performance and the second antioxidant performance, which makes it possible to accurately perform these estimations according to the different manners of the consumption. Further, the antioxidant performance is calculated based on the thus estimated first and second antioxidant performances, it is possible to further accurately estimate the antioxidant performance of the engine oil in its entirety.

More preferably, the first antioxidant performance-estimating means calculates a rate of change in oxidation induction time corresponding to the antioxidant in the engine oil by a following equation (A), and calculates the oxidation induction time $[OIT]_{AH}$ corresponding to the antioxidant as the first antioxidant performance, by integrating the calculated rate of change, and the second antioxidant performance-estimating means calculates a rate of change in oxidation induction time corresponding to the peroxide decomposer in the engine oil by a following equation (B), and calculates the oxidation induction time $[OIT]_{ZH}$ corresponding to the peroxide decomposer as the second antioxidant performance, by integrating the calculated rate of change, $$d[OIT]_{AH}/dt=k1+k2\times[NOx]^2+k3\times[\mathrm{FUEL}]^2 \quad (A)$$

$$d[OIT]_{ZN}/dt=[OIT]_{ZN}\times(k4+k5\times[NOx]^2+k6\times[\mathrm{FUEL}]^2) \quad (B)$$

wherein $d[OIT]_{AH}/dt$: rate of change in the oxidation induction time corresponding to the antioxidant, $d[OIT]_{ZN}/dt$: rate of change in the oxidation induction time corresponding to the peroxide decomposer, $[OIT]_{ZN}$: oxidation induction time corresponding to the peroxide decomposer, k1 to k6: reaction rate coefficients,

[NOx]: NOx concentration in the crankcase, and

[FUEL]: concentration of fuel in the engine oil.

The oxidation induction time is defined as described hereinafter, and has a close correlation with the antioxidant performance, therefore serving as an effective indicator thereof. Further, as described hereinafter, it has been confirmed by experiment that the rate of change in the oxidation induction time corresponding to the antioxidant and the rate of change in the oxidation induction time corresponding to the peroxide decomposer can be accurately calculated by the aforementioned equation (A) and the aforementioned equation (B), respectively.

Therefore, the rate of change in the oxidation induction time corresponding to the antioxidant can be accurately calculated by the aforementioned equation (A), and the oxidation induction time corresponding to the antioxidant can be accurately calculated as the first antioxidant performance by integrating the calculated rate of change. Similarly, the rate of change in the oxidation induction time corresponding to the peroxide decomposer can be accurately calculated by the aforementioned equation (B), and the oxidation induction time corresponding to the peroxide decomposer can be accurately calculated as the second antioxidant performance by integrating the calculated rate of change.

BEST MODE FOR CARRYING OUT THE INVENTION

Figure 1:
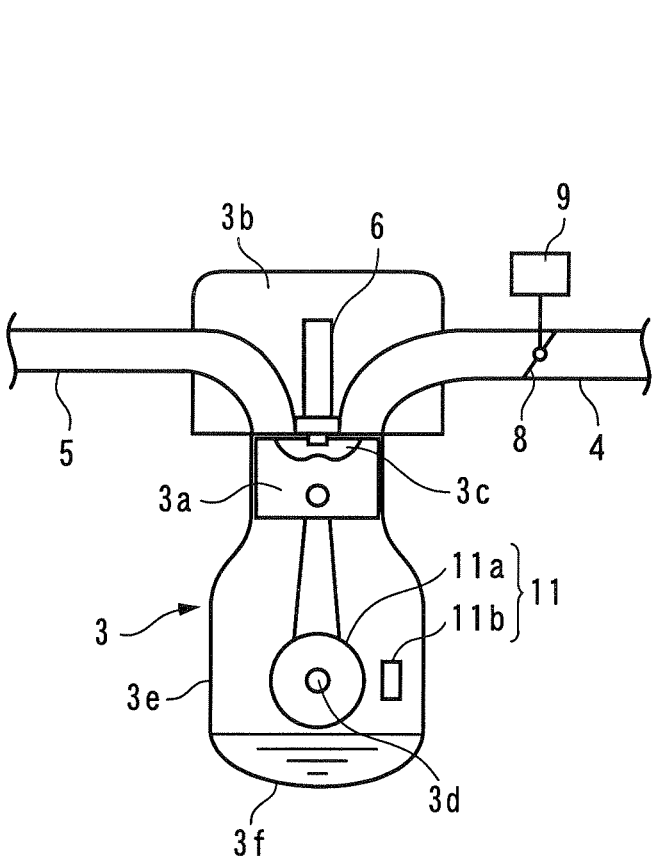
[FIG. 1] A schematic view of an internal combustion engine to which is applied the present invention.

The present invention will now be described in detail with reference to the drawings showing preferred embodiments thereof. Referring first to FIG. 1, there is schematically shown the arrangement of an internal combustion engine 3 to which is applied a control system according to the present invention. The internal combustion engine 3 (hereinafter simply referred to as "the engine") is a gasoline engine e.g. of a four-cylinder type, which is installed on an automotive vehicle (not shown).

A combustion chamber 3*c* is defined between each piston 3*a* and an associated cylinder head 3*b* of the engine 3. The cylinder head 3*b* has an intake pipe 4 and an exhaust pipe 5 connected thereto, with a fuel injection valve (hereinafter referred to as "the injector") 6 and a spark plug 7 (see FIG. 2) mounted therethrough such that they face the combustion chamber 3*c*. A fuel injection amount QINJ and fuel injection timing of fuel injected from the injector 6 and ignition timing of the spark plug 7 are controlled by an ECU 2, described hereinafter.

At the bottom of a crankcase 3*e* accommodating a crankshaft 3*d* etc., there is provided an oil pan 3*f*, within which engine oil for use in lubrication of the engine 3 is collected.

Further, a magnet rotor 11*a* is mounted on the crankshaft 3*d*. The magnet rotor 11*a* and an MRE pickup 11*b* form a crank angle sensor 11 (operating condition-detecting means) which delivers a CRK signal and a TDC signal, which are both pulse signals, to the ECU 2 along with rotation of the crankshaft 3*d*.

Each pulse of the CRK signal is generated whenever the crankshaft 3*d* rotates through a predetermined crank angle (e.g. 30°). The ECU 2 calculates rotational speed (hereinafter referred to as "the engine speed") NE of the engine 3 based on the CRK signal. The TDC signal indicates that the piston 3*a* of each cylinder is at a predetermined crank angle position in the vicinity of the top dead center (TDC) at the start of the suction stroke thereof, and in the case of the four-cylinder engine of the illustrated example, it is delivered whenever the crankshaft 3*d* rotates through 180 degrees.

Figure 12:
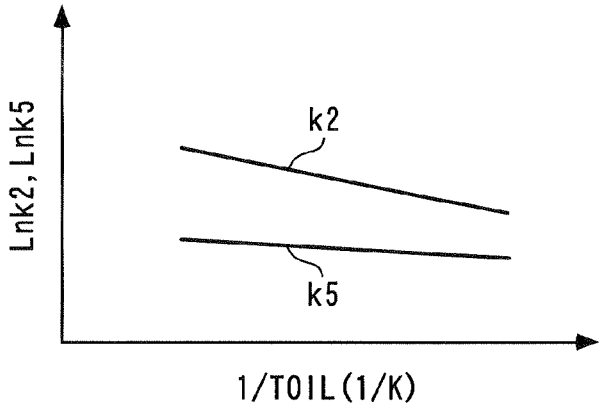
[FIG. 12] An example of a table for determining the reaction rate coefficients k2 and k5.

Further, the engine 3 is provided with a coolant temperature sensor 12 (see FIG. 12). The coolant temperature sensor 12 detects temperature TW of coolant circulating through the engine block of the engine 3 (hereinafter referred to as "the engine coolant temperature") and delivers a detection signal indicative of the detected engine coolant temperature TW to the ECU 2.

The intake pipe 4 has a throttle valve 8 arranged thereacross, and an actuator 9 comprised of a DC motor is connected to the throttle valve 8. The opening of the throttle valve 8 is controlled by controlling the duty factor of electric current supplied to the actuator 9 by the ECU 2, whereby the amount of intake air drawn into the combustion chamber 3*c* is controlled.

Figure 2:
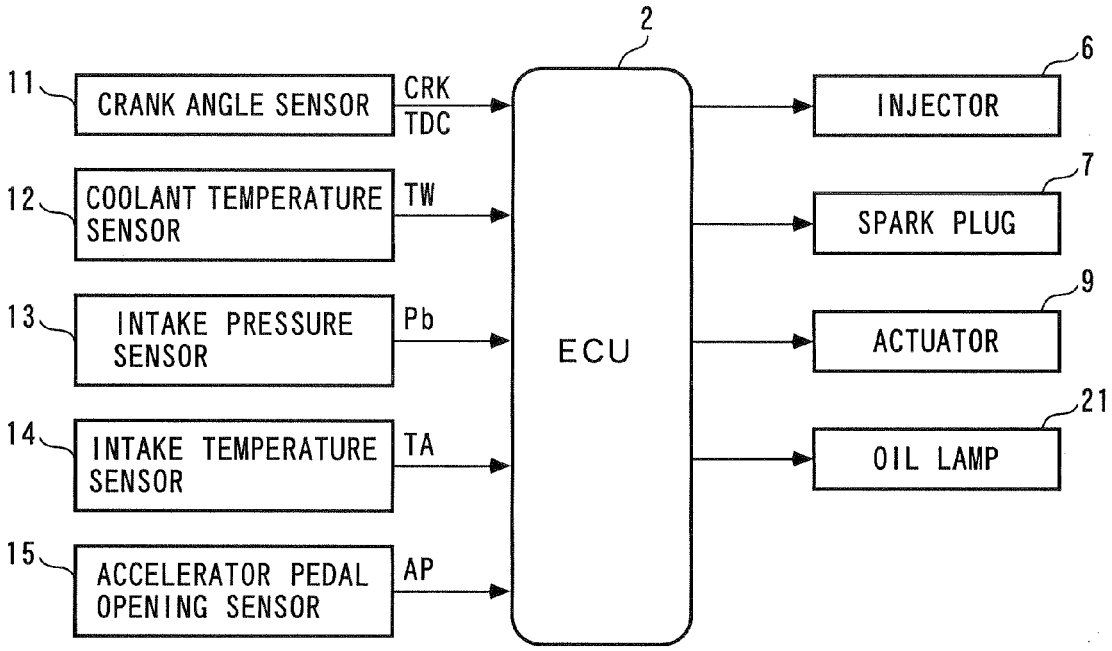
[FIG. 2] A diagram showing the input-output relations of signals input to and output from an ECU.

Further, the intake pipe 4 has an intake pressure sensor 13 and an intake temperature sensor 14 inserted therein at respective locations downstream of the throttle valve 8 (see FIG. 2). The intake pressure sensor 13 detects intake pressure Pb within the intake pipe 4 as an absolute value thereof, and delivers a detection signal indicative of the detected intake pipe pressure Pb to the ECU 2. Further, the intake temperature sensor 14 detects temperature TA of intake air flowing through the intake pipe 4 (hereinafter referred to as "the intake air temperature") and delivers a detection signal indicative of the detected intake air temperature TA to the ECU 2.

An accelerator pedal opening sensor 15 detects the degree of opening or stepped-on amount (hereinafter referred to as "the accelerator pedal opening") AP of an accelerator pedal, not shown, of the vehicle and delivers a signal indicative of the detected accelerator pedal opening AP to the ECU 2. Further, an oil lamp 21 is provided for a driver's seat of the vehicle, for indication of a degraded state of engine oil, and the oil lamp 21 is connected to the ECU 2.

The ECU 2 is implemented by a microcomputer comprised of an I/O interface, a CPU, a RAM, and a ROM. The detection signals from the aforementioned sensors 11 to 15 are input to the CPU after the I/O interface performs A/D conversion and waveform shaping thereon.

In response to these input signals, the CPU determines an operating condition of the engine 3, and depending on the determined operating condition of the engine, performs engine control, such as fuel injection control of the injector 6, intake air amount control, and ignition timing control, in accordance with control programs stored in the ROM.

Further, the ECU 2 carries out an oil degradation-determining process for determining degradation of engine oil. In the present embodiment, the ECU 2 implements antioxidant performance-estimating means, cleanliness preservation performance-estimating means, degradation estimation means, first and second remaining life parameter-calculating means, and first and second degradation parameter-calculating means. Further, the ECU 2 implements fuel concentration-acquiring means, oil concentration-acquiring means, and NOx concentration-acquiring means.

In the following, a description will be given of a method of estimating an oxidation induction time (hereinafter referred to as "OIT") for use in the above-mentioned oil degradation-determining process. The OIT is defined as a time period which it takes before heat starts to be generated when a sample oil and a predetermined reference substance are placed under predetermined high temperature and high pressure conditions, and has a close correlation with the antioxidant performance, thereby serving as an effective indicator of the antioxidant performance. Further, it has been confirmed that when the OIT remains in engine oil, no insoluble component occurs, or no low-temperature sludge is generated, which makes the OIT an excellent reference for determination of degradation of engine oil.

The OIT is calculated by the following equation (1):

$$[OIT]_{TOTAL}=[OIT]_{AH}+[OIT]_{ZN} \quad (1)$$

wherein $[OIT]_{TOTAL}$ represents a total OIT in engine oil, $[OIT]_{AH}$ a portion of OIT corresponding to antioxidant (hereinafter referred to as "first OIT", as deemed appropriate), and $[OIT]_{ZN}$ a portion of OIT corresponding to peroxide decomposer (hereinafter referred to as "second OIT", as deemed appropriate).

From the equation (1), there holds the following equation (2):

$$d[OIT]_{TOTAL}/dt=d[OIT]_{AH}/dt+[OIT]_{ZN}/dt \quad (2)$$

Further, the rate $d[OIT]_{AH}/dt$ of change in the first OIT and the rate $d[OIT]_{ZN}/dt$ of change in the second OIT are calculated respectively by the following equations (3) and (4):

$$d[OIT]_{AH}/dt=k1+k2\times[NOx]^2+k3\times[\mathrm{FUEL}]^2 \quad (3)$$

$$d[OIT]_{ZN}/dt=[OIT]_{ZN}\times(k4+k5\times[NOx]^2+k6\times[\mathrm{FUEL}]^2) \quad (4)$$

Here, k1 to k6 represent reaction rate coefficients of OIT, [NOx] a NOx concentration, and [FUEL] a fuel concentration (dilution rate) of engine oil.

Further, by subjecting the equations (3) and (4) to integration, the $[OIT]_{AH}$ and $[OIT]_{ZN}$ can be determined by the following equations (5) and (6):

$$[OIT]_{AH}=[OIT]_{AHINI}-(\Sigma k1+\Sigma k2\times[NOx]^2+\Sigma k3\times[\mathrm{FUEL}]^2) \quad (5)$$

$$[OIT]_{ZN}=[OIT]_{ZNINI}\times\mathrm{EXP}\{-(\Sigma k4+k5\times[NOx]^2+\Sigma k6\times[\mathrm{FUEL}]^2)\} \quad (6)$$

Here, $[OIT]_{AHINI}$ represents an initial value of $[OIT]_{AH}$, and $[OIT]_{ZNINI}$ an initial value of $[OIT]_{ZN}$.

The above-mentioned equations (3) and (4) are derived in the following manner: First, heat (oil temperature) is assumed as a first factor of degradation of OIT, and it is assumed that with respect to time, the first antioxidant performance $[OIT]_{AH}$ decreases linearly and the second antioxidant performance $[OIT]_{ZN}$ decreases exponentially. Then, the rate $d[OIT]_{AH}/dt$ of change in the first OIT and the rate $d[OIT]_{ZN}/dt$ of change in the second OIT can be expressed by the following equations (7) and (8):

$$d[OIT]_{AH}/dt=k1 \quad (7)$$

$$d[OIT]_{ZN}/dt=[OIT]_{ZN}k4 \quad (8)$$

Figure 3:
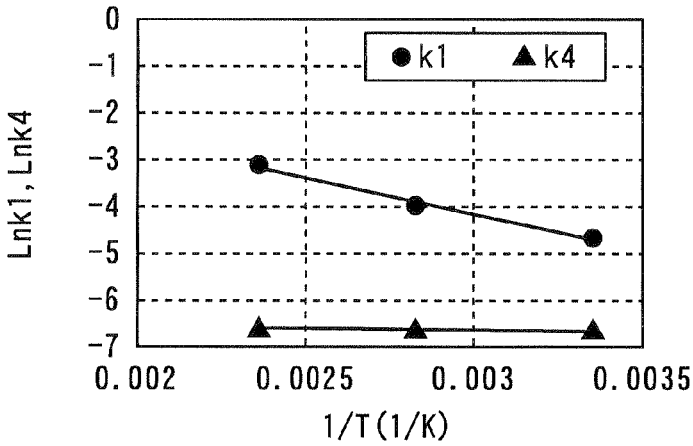
[FIG. 3] An Arrhenius plot diagram of reaction rate coefficients k1 and k4 of OIT.

Further, to confirm the validity of these equations, an experiment for consuming OIT is conducted by giving air and heat to engine oil. FIG. 3 shows results of Arrhenius plotting of the reaction rate coefficients k1 and k4 obtained by the experiment, and it has been confirmed that both the reaction rate coefficients k1 and k4 have an excellent linearity.

Next, NOx is assumed as a second factor of degradation of OIT, and it is assumed that degradation of OIT by NOx occurs independently of degradation of OIT by heat. Then, the rate $d[OIT]_{AH}/dt$ of change in the first OIT and the rate $d[OIT]_{ZN}/dt$ of change in the second OIT are expressed by the following equations (9) and (10):

$$d[OIT]_{AH}/dt=k1+A_{NOx} \quad (9)$$

$$d[OIT]_{ZN}/dt=[OIT]_{ZN}\times(k4+B_{NOx}) \quad (10)$$

wherein $A_{NOx}$ and $B_{NOx}$ are terms representative of rates of degradation of OIT by NOx.

Figure 4:
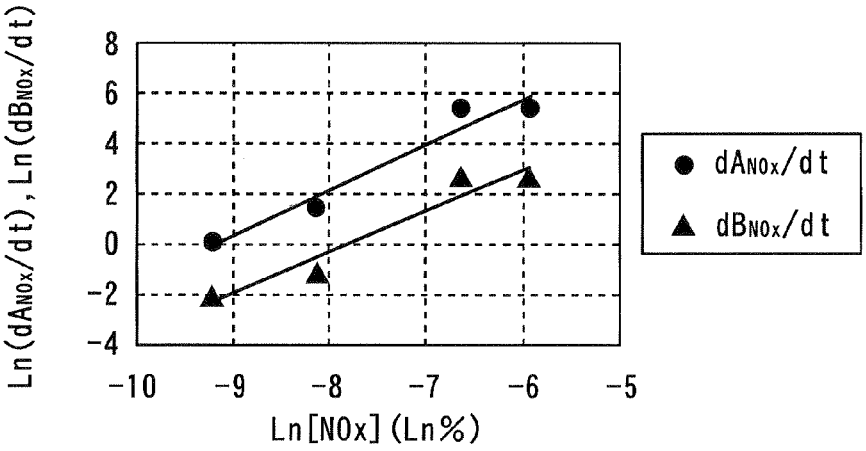
[FIG. 4] A diagram showing the relationship between degradation rate terms $A_{NOx}$ and $B_{NOx}$ of OIT and NOx concentration.

These degradation rate terms $A_{NOx}$ and $B_{NOx}$ can be determined by conducting experiments for consuming OIT under the respective conditions of NOx being present and NOx being absent, and calculating the differences between the respective rates of change of OIT obtained under the two conditions. FIG. 4 shows results of order analysis of results of the experiment by plotting the logarithm of the NOx concentration [NOx] along the horizontal axis and the logarithm of the rates of change in the degradation rate terms $A_{NOx}$ and $B_{NOx}$ along the vertical axis. From the slopes of straight lines, the order of reaction of NOx concentration [NOx] can be determined to be approximately equal to 2, for the two, and the results expressed in rate equations give the following equations (11) and (12):

$$d[OIT]_{AH}/dt=k1+k2\times[NOx]^2 \quad (11)$$

$$d[OIT]_{ZN}/dt=[OIT]_{ZN}\times(k4+k5\times[NOx]^2) \quad (12)$$

Figure 5:
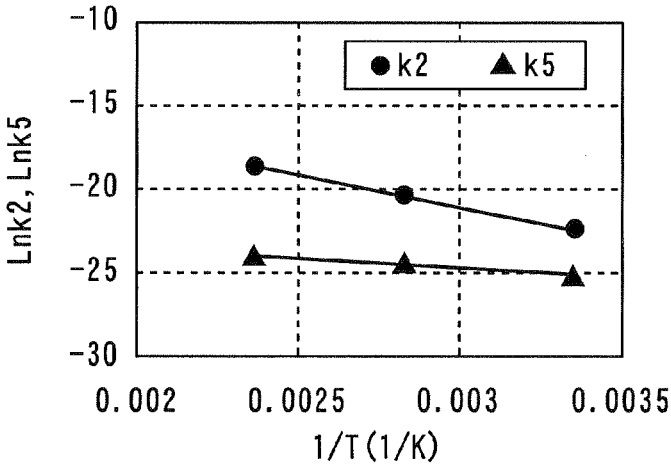
[FIG. 5] An Arrhenius plot diagram of reaction rate coefficients k2 and k5 of OIT.

FIG. 5 shows results of Arrhenius plotting of the reaction rate coefficients k2 and k5, and it has been confirmed that both the reaction rate coefficients k2 and k5 have an excellent linearity.

Next, fuel in engine oil is assumed as a third factor of degradation of OIT, and it is assumed that degradation of OIT by fuel occurs independently of degradations of OIT by heat and NOx. Then, the rate $d[OIT]_{AH}/dt$ of change in the first OIT and the rate $d[OIT]_{ZN}/dt$ of change in the second OIT are expressed by the following equations (13) and (14):

$$d[OIT]_{AH}/dt=k1+k2\times[NOx]^2+C_{FUEL} \quad (13)$$

$$d[OIT]_{ZN}/dt=[OIT]_{ZN}\times(k4+k5\times[NOx]^2+D_{FUEL}) \quad (14)$$

wherein $C_{FUEL}$, $D_{FUEL}$ represent terms of degradation of OIT by fuel.

Figure 6:
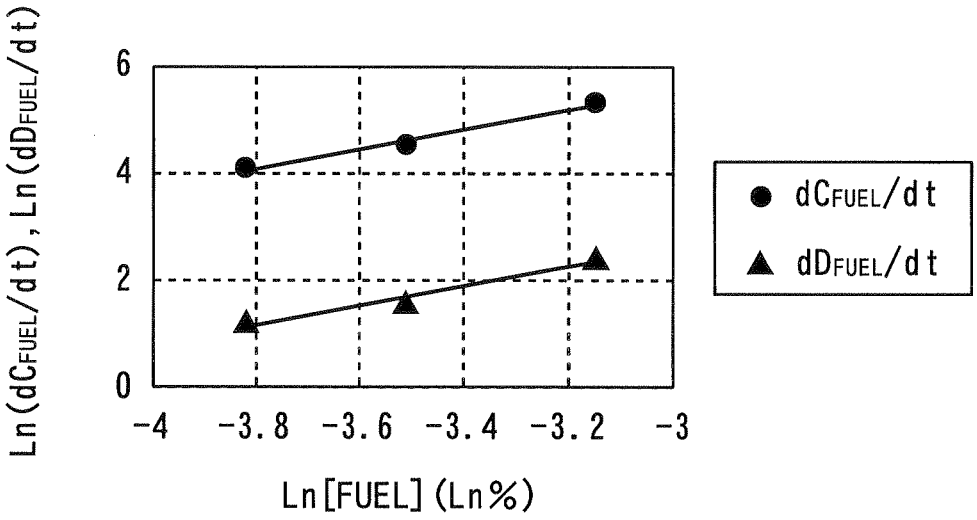
[FIG. 6] A diagram showing the relationships between fuel concentration and degradation rate terms $C_{FUEL}$ and $D_{FUEL}$ of OIT.

These degradation rate terms $C_{FUEL}$ and $D_{FUEL}$ can be determined by conducting experiments for consuming OIT under the respective conditions of fuel being present in engine oil and fuel being absent in the same, and calculating the differences between the respective rates of change of OIT obtained under the two conditions. FIG. 6 shows results of order analysis of the results of the experiment by plotting the logarithm of the fuel concentration [FUEL] and that of the rate of change in the degradation rate terms $C_{FUEL}$ and $D_{FUEL}$ along the horizontal axis and the vertical axis, respectively. From the slopes of respective straight lines, the order of reaction of fuel concentration [FUEL] can be determined to be approximately equal to 2, for the two, and the results expressed in rate equations give the aforementioned equations (3) and (4).

Figure 7:
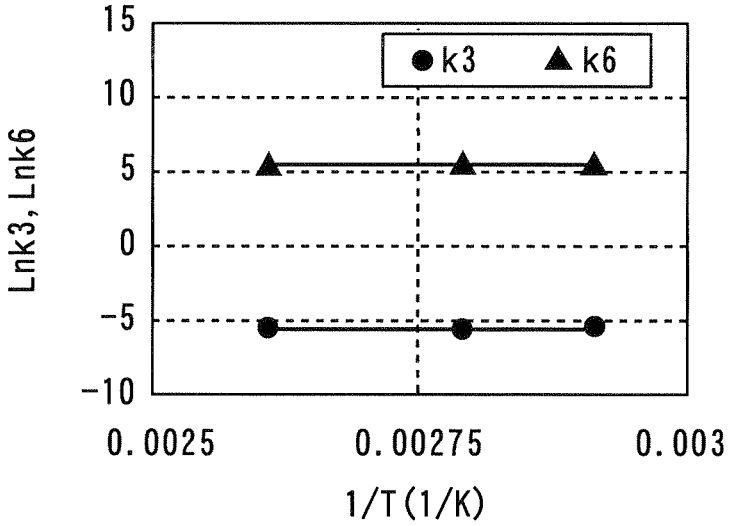
[FIG. 7] An Arrhenius plot diagram of reaction rate coefficients k3 and k6 of OIT.

Further, FIG. 7 shows results of Arrhenius plotting of the reaction rate coefficients k3 and k6, and it has been confirmed that both the reaction rate coefficients k3 and k6 have an excellent linearity.

Figure 8:
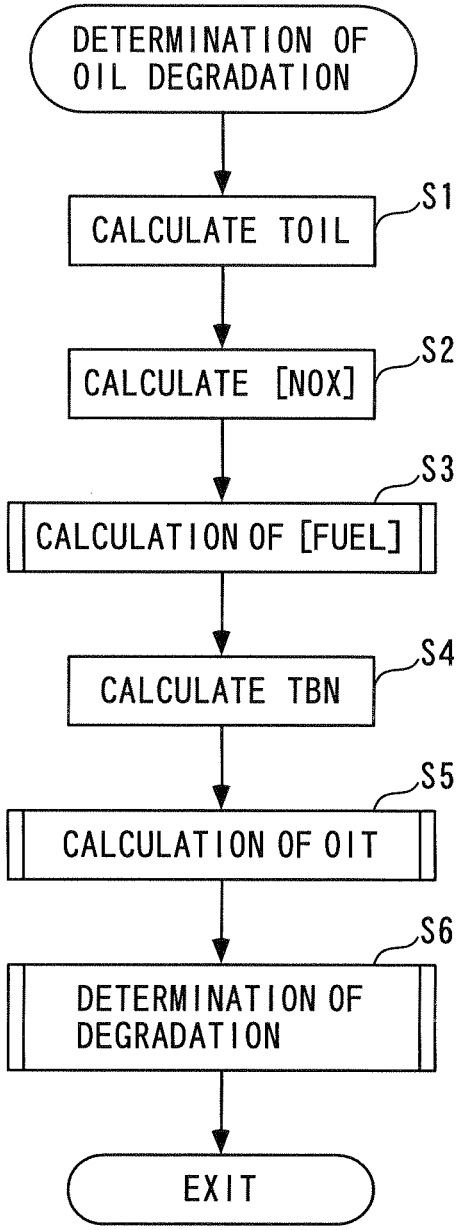
[FIG. 8] A flowchart showing a main flow of an engine oil degradation-determining process.

Next, a description will be given of an engine oil degradation-determining process executed by the ECU 2. FIG. 8 shows a main flow of the process which is executed whenever a predetermined time period (e.g. one second) elapses. In the present process, first, in a step 1 (shown as S1 in abbreviated form in FIG. 8; the following steps are also shown in abbreviated form), an oil temperature TOIL which is the temperature of engine oil is calculated. The calculation of the engine oil temperature TOIL is carried out by determining a basic value by searching a predetermined table (not shown) according to the engine coolant temperature TW, and correcting the determined basic value according to the intake air temperature TA, the intake pressure Pb, and the engine speed NE. It should be noted that the oil temperature TOIL may be directly detected by an oil temperature sensor disposed e.g. in the crankcase 3*e*.

Next, a NOx concentration [NOx] within the crankcase 3*e* is calculated (step 2). The calculation of the NOx concentration [NOx] is carried out by searching a predetermined map (not shown) according to the intake pressure Pb and the engine speed NE, and correcting the retrieved map value according to the fuel injection amount QINJ, ignition timing, etc.

Figure 9:
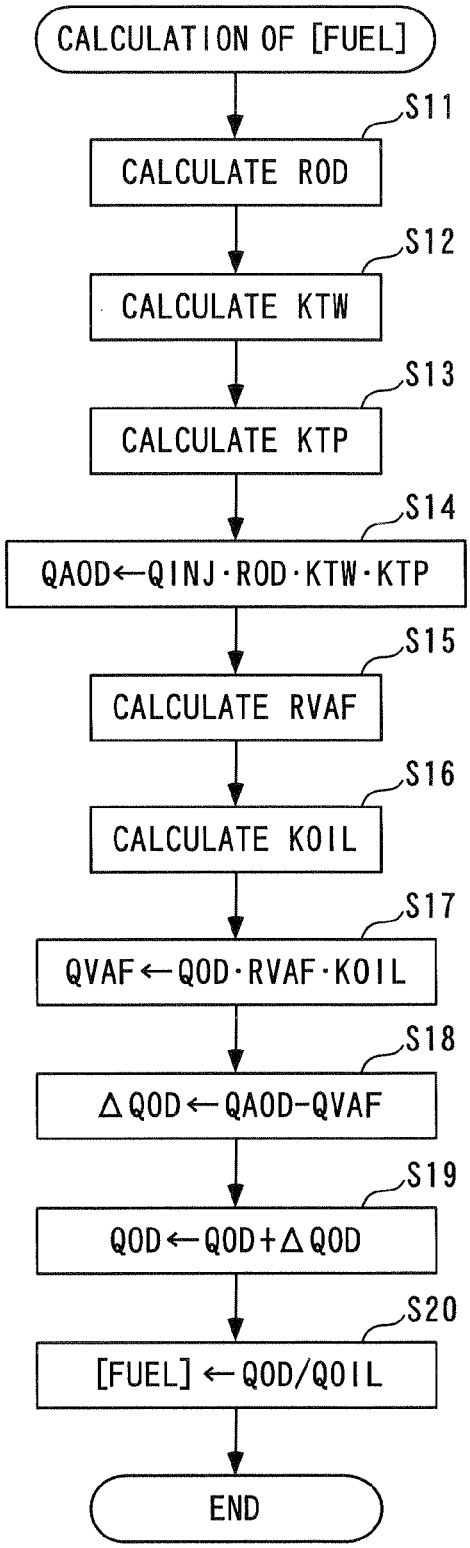
[FIG. 9] A flowchart showing a subroutine of a fuel concentration-calculating process.

Next, the concentration (dilution rate) [FUEL] of fuel in engine oil is calculated (step 3). FIG. 9 shows a subroutine therefor. This process is executed in synchronism with reception of each TDC signal pulse. First, a mixed fuel amount QAOD is calculated in steps 11 to 14. The mixed fuel amount QAOD represents an amount of fuel per TDC event, which is injected by the injector 6, attached to a cylinder wall and the like without being exhausted from the combustion chamber 3*c*, and subsequently mixed into engine oil.

First, in the step 11, a predetermined map (not shown) is searched according to the engine speed NE and the fuel injection amount QINJ, to thereby determine a mixed fuel ratio ROD. The mixed fuel ratio ROD represents a ratio of the amount of fuel mixed into engine oil to the amount of injected fuel. The map is configured such that as the engine speed NE is lower, the mixed fuel ratio ROD is set to a larger value, because as the engine speed NE is lower, the injected fuel is more difficult to atomize, and is easier to attach to the cylinder wall.

Next, a coolant temperature-dependent correction coefficient KTW is calculated by searching a predetermined table (not shown) according to the engine temperature TW (step 12). The table is configured such that as the engine temperature TW is lower, the engine temperature-dependent correction coefficient KTW is set to a larger value, because as the engine temperature TW is lower, the injected fuel is more difficult to atomize.

Next, a fuel injection timing-dependent correction coefficient KTP is calculated by searching a predetermined table (not shown) according to an injection timing (step 13). The table is configured such that as the injection timing is more retarded, the fuel injection timing-dependent correction coefficient KTP is set to a larger value, because as the injection timing is more retarded, the pressure and temperature of the inside of the cylinder become lower, and hence injected fuel becomes more difficult to atomize.

Next, the mixed fuel amount QAOD is calculated using the fuel injection amount QINJ, and the mixed fuel ratio ROD, the coolant temperature-dependent correction coefficient KTW, and the fuel injection timing-dependent correction coefficient KTP calculated in the respective steps 11 to 13, by the following equation (15)(step 14).

$$QAOD=QINJ\times ROD\times KTW\times KTP \quad (15)$$

Next, in steps 15 to 17, a fuel evaporation amount QVAF is calculated. The fuel evaporation amount QVAF represents an amount of fuel evaporated from engine oil per TDC event.

First, in the step 15, a fuel evaporation ratio RVAF is calculated by searching a predetermined map (not shown) according to the engine speed NE and the fuel injection amount QINJ. The fuel evaporation ratio RVAF represents a ratio of the amount of evaporated fuel to the total amount of fuel mixed into engine oil. Further, the above map is configured such that as the engine speed NE is larger, and as the fuel injection amount QINJ is larger, the fuel evaporation ratio RVAF is set to a larger value, because as the engine speed NE is larger, and as the fuel injection amount QINJ is larger, the temperature of the engine block of the engine 3 is higher, and hence fuel is easier to evaporate from engine oil.

Next, an oil temperature-dependent correction coefficient KOIL is calculated by searching a predetermined table (not shown) according to the oil temperature TOIL (step 16). The table is configured such that as the oil temperature TOIL is higher, the oil temperature-dependent correction coefficient KOIL is set to a larger value, because as the oil temperature TOIL is higher, engine oil is easier to evaporate from engine oil.

Next, the fuel evaporation amount QVAF is calculated using a fuel dilution amount QOD, and the fuel evaporation ratio RVAF and the oil temperature-dependent correction coefficient KOIL, which are obtained up to the time, by the following equation (16)(step 17). It should be noted that the fuel dilution amount QOD represents a total amount of fuel contained in engine oil and is reset to 0 upon replacement of engine oil.

$$QVAF=QOD\times RVAF\times KOIL \quad (16)$$

Next, the difference between the mixed fuel amount QAOD and the fuel evaporation amount QVAF calculated in the respective steps 14 and 17 is calculated as a per-TDC dilution amount ΔQOD (step 18). Then, the fuel dilution amount QOD is calculated by adding the per-TDC dilution amount ΔQOD calculated this time to the value of the fuel dilution amount QOD obtained up to the time (step 19).

Finally, the fuel concentration [FUEL] is calculated by dividing the calculated fuel dilution amount QOD by an engine oil amount QOIL (step 20), followed by terminating the present process. The engine oil amount QOIL represents a total amount of engine oil, and is set, for example, to a predetermined value.

Referring again to FIG. 8, in a step 4 following the step 3, a total base number of engine oil (hereinafter referred to as "TBN") is calculated. The TBN is a value which represents a remaining amount of cleaning agent added to engine oil, and serves as an indicator of the cleanliness preservation performance for keeping engine oil clean. It is known that if the TBN value becomes lower than a certain limit value, formation of a high-temperature sludge becomes conspicuous, and similarly to OIT, it is an oil degradation parameter which excellently indicates the degree of degradation of engine oil.

The calculation of TBN is carried out e.g. in the following manner: First, using the oil temperature TOIL and the NOx concentration [NOx] determined in the respective steps 1 and 2, the rate d[TBN]/dt of change in the TBN is calculated by the following equation (17):

$$d[TBN]/dt=k7\times[TBN]^2+k8\times[TBN]\times[NOx]^2+k9 \quad (17)$$

wherein k7 to k9 represent reaction rate coefficients determined by experiment.

Then, by subjecting the equation (17) to integration, the TBN is calculated by the following equation (18):

$$TBN=1/\{k7\times t+(1/[TBN]_{INI})\}+k8\times[NOx]^2\times t+k9\times t \quad (18)$$

Here, $[TBN]_{INI}$ represents an initial value of TBN.

Figure 10:
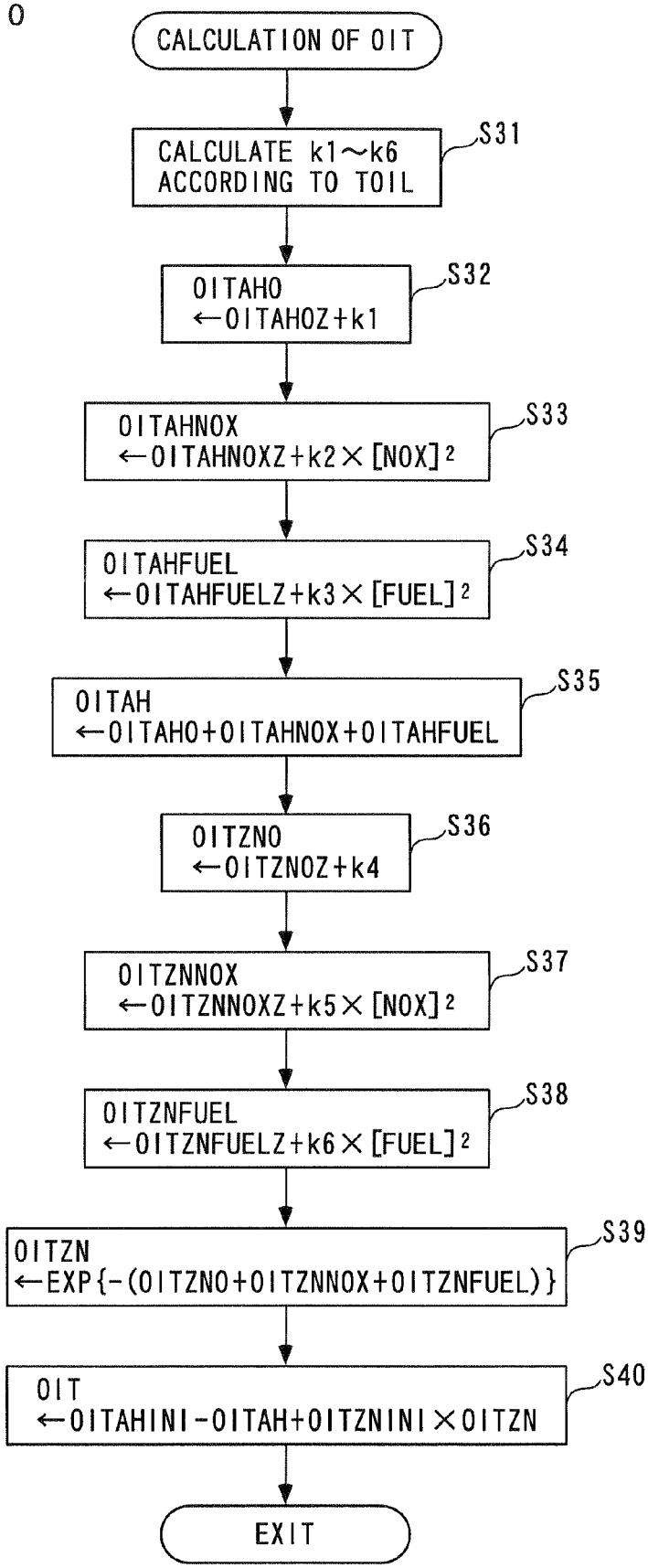
[FIG. 10] A flowchart showing a subroutine of an OIT-calculating process.
Figure 11:
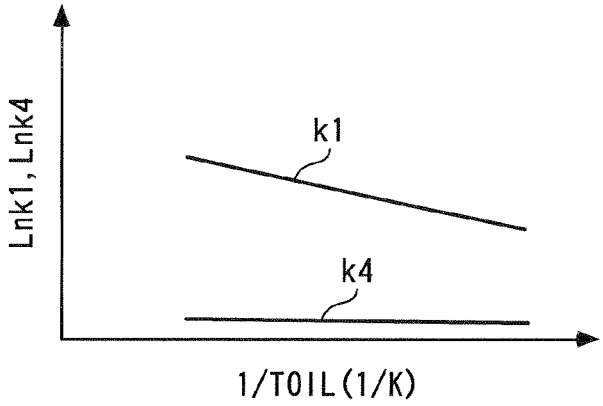
[FIG. 11] An example of a table for determining the reaction rate coefficients k1 and k4.
Figure 13:
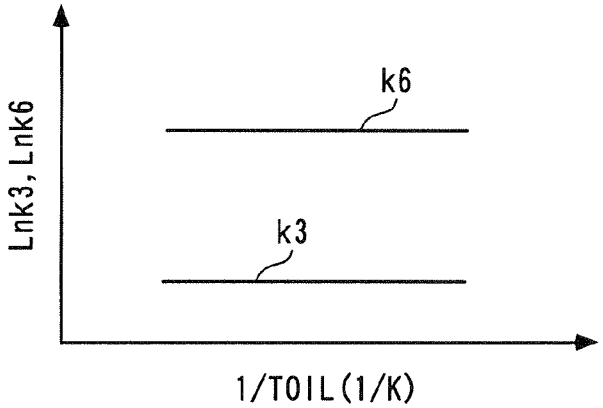
[FIG. 13] An example of a table for determining the reaction rate coefficients k3 and k6.

Next, in a step 5, the OIT is calculated. FIG. 10 shows a subroutine for the calculation, and the calculation of OIT is executed according to the equations (3) to (6). First, in a step 31, tables shown in FIGS. 11 to 13 are searched according to the oil temperature TOIL to determine the respective logarithms Lnk1 to Lnk6 of the reaction rate coefficients, and calculate the reaction rate coefficients k1 to k6 from the determined logarithms Lnk1 to Lnk6.

These tables are formed by determining the respective relationships between the oil temperature TOIL and the reaction rate coefficients k1 to k6, by experiment, and by Arrhenius plotting of the determined relationships. These tables basically show the same tendency of the temperature—k1 to k6 characteristics diagrams shown in FIGS. 3, 5, and 7. It should be noted that the above tables are of Arrhenius type, but instead of using them, by plotting the oil temperature TOIL along the horizontal axis and the reaction rate coefficients k1 to k6 along the vertical axis, k1 to k6 values may be directly determined by searching according to the oil temperature TOIL.

Next, in respective steps 32 to 34, a temperature term OITAHO, a NOx term OITAHNOX, and a fuel term OITAHFUEL, corresponding to the antioxidant, which correspond to Σk1, Σk2×$[NOx]^2$, and Σk3×$[FUEL]^2$ in the equation (5), respectively, are calculated, respectively.

More specifically, in the step 32, the temperature term OITAHO is calculated by adding the reaction rate coefficient k1 to its initial value OITAHOZ. In the step 33, the NOx term OITAHNOX is calculated by adding the product (=k2·$[NOx]^2$) of the reaction rate coefficient k2 and the square of the NOx concentration [NOx] to its initial value OITAHNOXZ. Further, in the step 34, the fuel term OITAHFUEL is calculated by adding the product (=k3·$[FUEL]^2$) of the reaction rate coefficient k3 and the square of the fuel concentration [FUEL] to its initial value OITAHFUELZ. It should be noted that the above initial values OITAHOZ, OITAHNOXZ, and OITAHFUELZ are all reset to 0 upon replacement of engine oil.

Next, in a step 35, a subtraction term OITAH corresponding to the antioxidant is calculated by adding the thus calculated temperature term OITAHO, NOx term OITAHNOX, and fuel term OITAHFUEL to each other, using the following equation (19):

$$OITAH=OITAHO+OITAHNOX+OITAHFUEL \quad (19)$$

The subtraction term OITAH corresponds to the second term on the right side of the equation (5), and represents a total amount of decrease in OIT corresponding to the antioxidant, occurring from the time of replacement of engine oil.

Next, in respective steps 36 to 38, a temperature term OITZNO, a NOx term OITZNNOX, and a fuel term OITZNFUEL, corresponding to the peroxide decomposer, which correspond to $\Sigma k4$, $\Sigma k5\times[NOx]^2$, and $\Sigma k6\times[FUEL]^2$ in the equation (6), respectively, are calculated.

More specifically, in the step 36, the temperature term OITZNO is calculated by adding the reaction rate coefficient k4 to its initial value OITZNOZ. In the step 37, the NOx term OITZNNOX is calculated by adding the product ($=k5\cdot[NOx]^2$) of the reaction rate coefficient k5 and the square of the NOx concentration [NOx] to its initial value OITZNNOXZ. Further, in the step 38, the fuel term OITZNFUEL is calculated by adding the product ($=k6\cdot[FUEL]^2$) of the reaction rate coefficient k6 and the square of the fuel concentration [FUEL] to its initial value OITZNFUELZ. It should be noted that the above initial values OITZNOZ, OITZNNOXZ, and OITZNFUELZ are all reset to 0 upon replacement of engine oil.

Next, in a step 39, the multiplication term OITZN corresponding to the peroxide decomposer is calculated by using the thus calculated temperature term OITZNO, NOx term OITZNNOX, and fuel term OITZNFUEL, by the following equation (20):

$$OITZN=\mathrm{EXP}\{-(OITZNO+OITZNNOX+OITZNFUEL)\} \quad (20)$$

The multiplication term OITZN corresponds to a multiplication term by which the initial value $[OIT]_{ZNINI}$ on the right side of the equation (6) is multiplied.

The, in a step 40, the OIT is calculated using the subtraction term OITAH corresponding to the antioxidant calculated in the step 35 and the multiplication term OITZN corresponding to the peroxide decomposer, by the following equation (21):

$$OIT=OITAHINI-OITAH+OITZNINI\times OITZN \quad (21)$$

followed by terminating the present process.

This equation (21) corresponds to the equations (1), (5), and (6), and OITAHINI and OITZNINI represent an initial value of OIT corresponding to the antioxidant and an initial value of OIT corresponding to the peroxide decomposer.

Referring again to FIG. 8, in a step 6 following the step 5, based on the TBN and OIT determined as described above, degradation of engine oil is determined, followed by terminating the present process.

Figure 14:
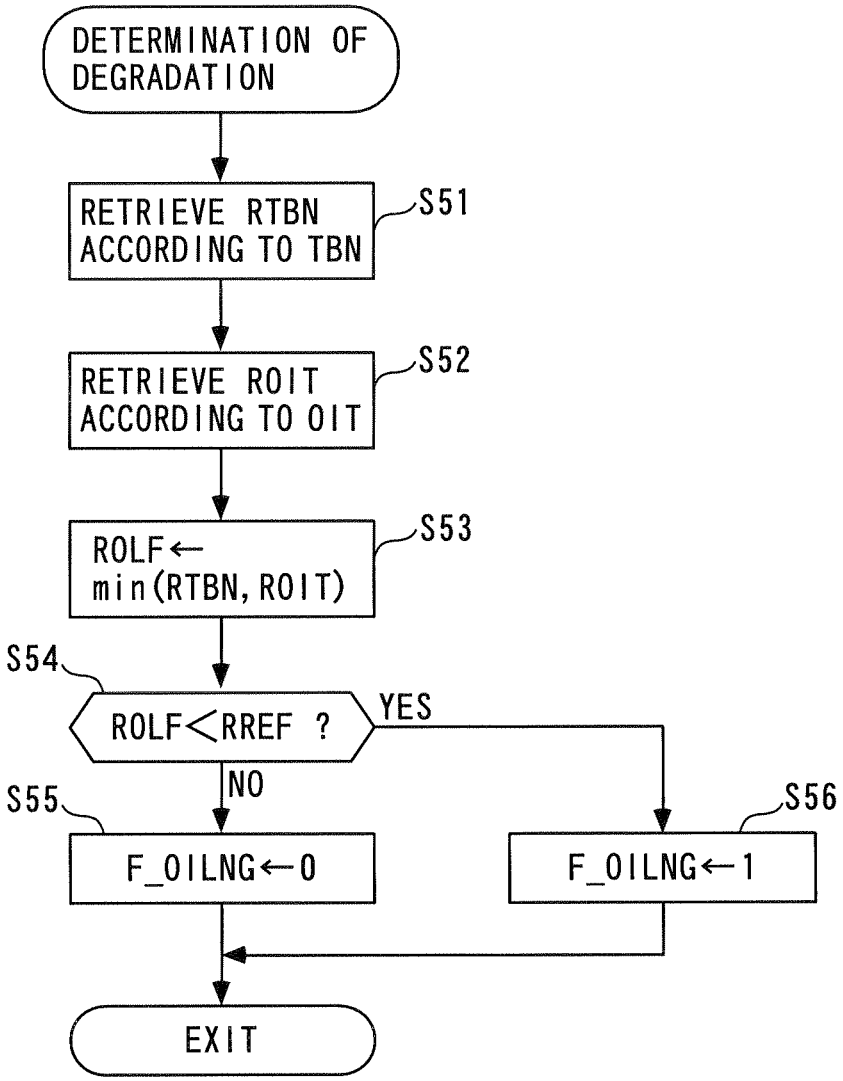
[FIG. 14] A flowchart showing a subroutine of a degradation determination process.
Figure 15:
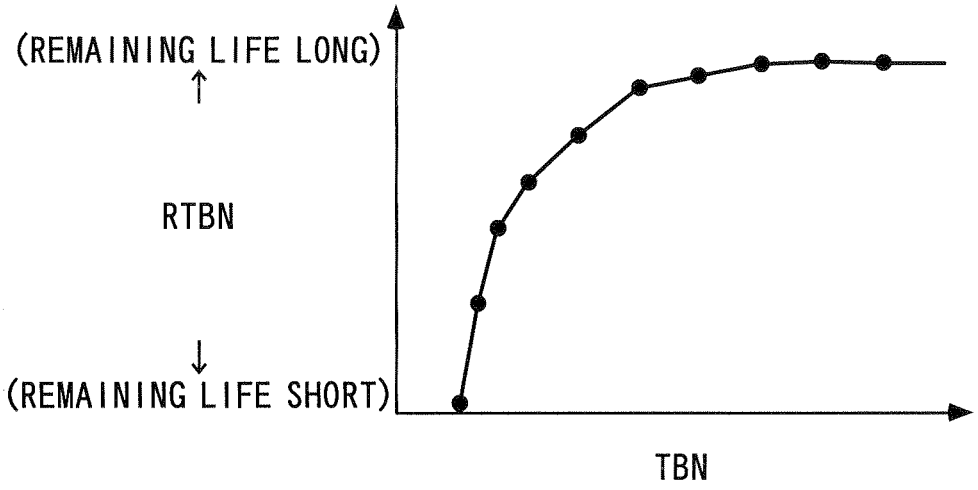
[FIG. 15] An example of a table for determining a remaining life indicator RTBN.

FIG. 14 shows a subroutine for the determination. First, in a step 51, a remaining life indicator RTBN based on TBN is calculated by searching a table shown in FIG. 15 according to the TBN. This table is formed by determining the relationship between a TBN value and the remaining life of engine oil e.g. by experiment, and represents the relationship as the remaining life indicator RTBN. As the value of the remaining life indicator RTBN is smaller, it indicates the degree of degradation of engine oil is higher and the remaining life thereof is shorter, and hence in this table, as the TBN value is smaller, the remaining life indicator RTBN is set to a smaller value.

Figure 16:
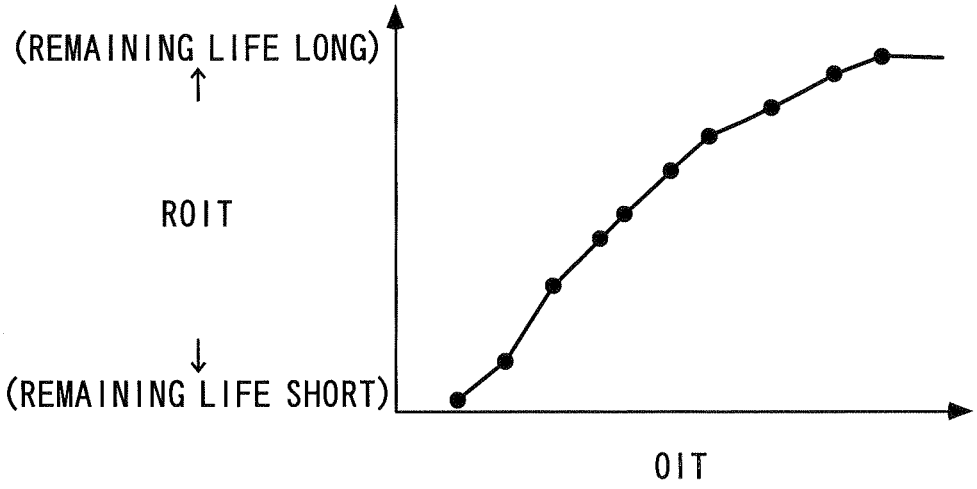
[FIG. 16] An example of a table for determining a remaining life indicator ROIT.

Next, by searching a table shown in FIG. 16 according to OITN, a remaining life indicator ROIT based on OIT is calculated (step 52). This table is formed by determining the relationship between an OIT value and the remaining life of engine oil e.g. by experiment, and represents the relationship as the remaining life indicator ROIT. As the value of the remaining life indicator ROIT is smaller, it also indicates the degree of degradation of engine oil is higher and the remaining life thereof is shorter, and hence in this table, as the OIT value is smaller, the remaining life indicator ROIT is set to a smaller value.

Next, the smaller one of the remaining life indicators RTBN and ROIT determined in the respective steps 51 and 52 is set as a finial remaining life indicator ROLF (step 53), and it is determined whether or not the finial remaining life indicator ROLF is smaller than a predetermined reference value RREF (step 54).

If the answer to this question is negative (NO), i.e. if ROLF≧RREF holds, it is determined that the engine oil has not been degraded, and an oil degradation flag F_OILNG is set to 0 (step 55), followed by terminating the present process.

On the other hand, if the answer to the question of the step 54 is affirmative (YES), i.e. if ROLF<RREF holds, it is determined that the engine oil has been degraded, and the oil degradation flag F_OILNG is set to 1 to indicate the fact (step 56), followed by terminating the present process. When the oil degradation flag F_OILNG is thus set to 1, the oil lamp 21 is turned on by a control signal from the ECU 2, whereby the driver is urged to carry out replacement of oil.

As described above, according to the present embodiment, the OIT indicative of a degree of consumption of the antioxidant performance, which is a factor of formation of low-temperature sludge in engine oil, and the TBN indicative of a degree of consumption of the cleanliness preservation performance, which is a factor of formation of high-temperature sludge in engine oil are calculated separately from each other, and degradation of engine oil is determined based on the calculated OIT and TBN. Thus, the degradation determination is carried out using the two different types of oil degradation parameters OIT and TBN, which makes it possible to accurately determine degradation of engine oil while setting the safety factor for the determination to be smaller than when a single oil degradation parameter is employed, and therefore, it is possible to properly determine the time for replacement of engine oil.

Further, the OIT and TBN are determined only by calculation without using determination-dedicated sensors as employed in the conventional degradation determining device, and hence the present engine oil degradation-estimating device can be constructed more inexpensively.

Further, the remaining life indicators ROIT and RTBN respectively indicative of the remaining lives of engine oil are calculated based on the calculated OIT and TBN, and the degradation of engine oil is determined by comparing a smaller one of the indicators with the reference value RREF. Therefore, it is possible to accurately determine the time for replacement of engine oil. Further, according to the determination method described above, the safety factor for each of the OIT and the TBN can be set to be smaller, whereby the accuracy of degradation determination can be further enhanced.

Further, the $[OIT]_{AH}$ corresponding to the antioxidant and $[OIT]_{ZN}$ corresponding to the peroxide decomposer are calculated separately from each other (the equations (5) and (6)), and by adding the two, the $[OIT]_{TOTAL}$ for the engine oil in its entirety is calculated (the equation (1)). Therefore, according to the difference in the manner of consumption between the antioxidant and the peroxide composer, the $[OIT]_{AH}$ value and the $[OIT]_{ZN}$ value are accurately calculated, whereby the OIT for the engine oil in its entirety can be accurately calculated. Therefore, the accuracy of degradation determination can be further enhanced.

Further, according to the present embodiment, the OIT as an indicator of the antioxidant performance of engine oil is calculated based on the fuel concentration [FUEL] in engine oil, and further based on the oil temperature TOIL and the NOx concentration [NOx] in the crankcase 3*e*. Therefore, it is possible to accurately estimate the OIT, while causing influence of the fuel, the oil temperature, and NOx to be reflected thereon, and determine the degradation of engine oil and time for replacement thereof based on the estimated OIT.

Further, the OIT is calculated (estimated) using the fuel concentration [FUEL], the oil temperature TOIL, and the NOx concentration [NOx], and the above-mentioned three parameters are calculated (estimated) using results of detections by the sensors 11 to 14 which are normally provided for control of the engine 3. Therefore, compared with the conventional case where an expensive infrared spectrometer is used for directly detecting the antioxidant performance of engine oil, the device can be constructed very inexpensively.

Further, the rate $d[OIT]_{AH}/dt$ of change of $[OIT]_{AH}$ corresponding to the antioxidant is calculated by the equation (3), and then the $[OIT]_{AH}$ corresponding to the antioxidant is calculated by integrating the rate $d[OIT]_{AH}/dt$ of the change by the equation (5). This makes it possible to accurately calculate the $[OIT]_{AH}$. Similarly, the rate $d[OIT]_{AH}/dt$ of change of $[OIT]_{ZN}$ corresponding to the peroxide decomposer is calculated by the equation (4), and the $[OIT]_{ZN}$ corresponding to the peroxide decomposer is calculated by integrating the rate $d[OIT]_{AH}/dt$ of the change by the equation (6). This makes it possible to accurately calculate the $[OIT]_{ZN}$.

It should be noted that the present invention is by no means limited to the embodiment described above, but it can be practiced in various forms. For example, although in the present embodiment, the OIT is used as an indicator indicative of the antioxidant performance, and the TBN is used as an indicator indicative of the cleanliness preservation performance, this is not limitative but other suitable indicators can be employed. For example, as an indicator indicative of the antioxidant performance, there may be used a limit amount of a predetermined reagent that accelerates oxidation, which is determined as an amount of the reagent which is continuously added to engine oil until the engine oil cannot prevent oxidation any longer, or a value of pressure of a closed space in which engine oil and oxygen are sealed, which is measured after pressurizing and heating the engine oil and oxygen in the closed space, and when a predetermined time period has elapsed causing the pressure to drop due to reaction between the antioxidant and oxygen. Further, as an indicator indicative of the cleanliness preservation performance, there may used a score of the color of engine oil or the amount of carbide, which is determined by a so-called hot tube test. Further, the methods of calculation of the OIT and the TBN are described in the present embodiment only by way of example, and any other suitable methods may be employed.

Further, although in the present embodiment, the degradation of engine oil is determined based on the calculated OIT and TBN, the present invention can be applied to estimation of degradation of engine oil for purposes other than described above. For example, the degree of degradation of engine is estimated based on OIT and the like, and further, from the estimated degree of degradation, a state of change in friction of pistons of the engine is estimated, for use in fuel injection control.

Further, although in the embodiment, the concentration (dilution rate) of fuel in engine oil is estimated depending on operating conditions of the engine 3, such as the fuel injection amount QINJ and the engine speed NE, it may be directly detected using a sensor. Similarly, although the predetermined value is used as the engine oil amount QOIL for use in determining the fuel concentration, it may be detected by an oil level sensor or the like.

Further, although in the present embodiment, the oil temperature TOIL, and the NOx concentration [NOx] and the fuel concentration [FUEL] in the crankcase 3*e* are all acquired by estimation, these parameters as well may be directly detected using respective sensors. In this case as well, the sensors required therefor are much less expensive than the conventionally used infrared spectrometer, and hence the present device can be more inexpensively constructed.

Further, although in the above-described embodiments, the present invention is applied to the automotive gasoline engine by way of example, this is not limitative, but it can be applied to various types of engines, such as diesel engines and engines for ship propulsion machines, such as an outboard motor having a vertically-disposed crankshaft. Besides, details of the embodiment can be modified as desired insofar as they are within the scope of the gist of the present invention.

INDUSTRIAL APPLICABILITY

As described heretofore, the engine oil degradation-estimating device according to the first and second embodiments of the present invention can be applied to various internal combustion engines as degradation estimation devices which can inexpensively and accurately determine degradation of engine oil, and thereby properly determine the time for replacement of engine oil. Further, the device for estimating an antioxidant performance of engine oil according to the third aspect of the present invention can accurately estimate the antioxidant performance of engine oil without using an expensive sensor, whereby it can be used in various internal combustion engines as an estimation device that can properly determine degradation of engine oil and time for replacement of engine oil.

The invention claimed is:

1. A device for estimating an antioxidant performance of engine oil, which is used as an indicator for determining degradation of engine oil, comprising:

fuel concentration-acquiring means for acquiring a concentration of fuel in the engine oil; and antioxidant performance-estimating means for estimating an antioxidant performance of engine oil, based on the acquired concentration of fuel;

wherein said antioxidant performance-estimating means comprises:

first antioxidant performance-estimating means for estimating an antioxidant performance of an antioxidant contained in the engine oil as a first antioxidant performance; and second antioxidant performance-estimating means for estimating an antioxidant performance of a peroxide decomposer contained in the engine oil as a second antioxidant performance, and calculates the antioxidant performance based on the estimated first antioxidant performance and second antioxidant performance;

wherein said first antioxidant performance-estimating means calculates a rate of change in oxidation induction time corresponding to the antioxidant in the engine oil by a following equation (A), and calculates the oxidation induction time corresponding to the antioxidant as the first antioxidant performance, by integrating the calculated rate of change, and wherein said second antioxidant performance-estimating means calculates a rate of change in oxidation induction time corresponding to the peroxide decomposer in the engine oil by a following equation (B), and calculates the oxidation induction time corresponding to the peroxide decomposer as the second antioxidant performance, by integrating the calculated rate of change, $$d[OIT]_{AH}/dt=k1+k2\times[NOx]^2+k3\times[\mathrm{FUEL}]^2 \quad (A)$$

$$d[OIT]_{zN}/dt=[OIT]_{zN\,x}(k4+k5\times[NOx]^2+k6\times[\mathrm{FUEL}]^2) \quad (B)$$

wherein $d[OIT]_{AH}/dt$: rate of change in the oxidation induction time corresponding to the antioxidant, $d[OIT]_{zN}/dt$: rate of change in the oxidation induction time corresponding to the peroxide decomposer, $[OIT]_{ZN}$: oxidation induction time corresponding to the peroxide decomposer, k1 to k6: reaction rate coefficients,

[NOx]: NOx concentration in the crankcase, and

[FUEL]: concentration of fuel in the engine oil.

2. A device for estimating an antioxidant performance of engine oil, which is used as an indicator for determining degradation of engine oil, comprising:

fuel concentration-acquiring means for acquiring a concentration of fuel in the engine oil;

antioxidant performance-estimating means for estimating an antioxidant performance of engine oil, based on the acquired concentration of fuel;

oil temperature-acquiring means for acquiring a temperature of engine oil; and

NOx concentration-acquiring means for acquiring a NOx concentration within a crankcase of the engine, wherein said antioxidant performance-estimating means estimates the antioxidant performance further based on the acquired oil temperature and NOx concentration;

wherein said antioxidant performance-estimating means comprises:

first antioxidant performance-estimating means for estimating an antioxidant performance of an antioxidant contained in the engine oil as a first antioxidant performance; and second antioxidant performance-estimating means for estimating an antioxidant performance of a peroxide decomposer contained in the engine oil as a second antioxidant performance, and calculates the antioxidant performance based on the estimated first antioxidant performance and second antioxidant performance;

wherein said first antioxidant performance-estimating means calculates a rate of change in oxidation induction time corresponding to the antioxidant in the engine oil by a following equation (A), and calculates the oxidation induction time corresponding to the antioxidant as the first antioxidant performance, by integrating the calculated rate of change, and wherein said second antioxidant performance-estimating means calculates a rate of change in oxidation induction time corresponding to the peroxide decomposer in the engine oil by a following equation (B), and calculates the oxidation induction time corresponding to the peroxide decomposer as the second antioxidant performance, by integrating the calculated rate of change, $$d[OIT]_{AH}/dt=k1+k2\times[NOx]^2+k3\times[\mathrm{FUEL}]^2 \quad (A)$$

$$d[OIT]_{ZN}/dt=[OIT]_{ZN\times}(k4+k5\times[NOx]^2+k6\times[\mathrm{FUEL}]^2) \quad (B)$$

wherein $d[OIT]_{AH}/dt$: rate of change in the oxidation induction time corresponding to the antioxidant, $d[OIT]_{ZN}/dt$: rate of change in the oxidation induction time corresponding to the peroxide decomposer, $[OIT]_{ZN}$: oxidation induction time corresponding to the peroxide decomposer, k1 to k6: reaction rate coefficients,

[NOx]: NOx concentration in the crankcase, and

[FUEL]: concentration of fuel in the engine oil.

* * * * *